United States Patent [19]

Mieyal

[11] 4,257,206

[45] Mar. 24, 1981

[54] FIRE RATED CEILING

[75] Inventor: David F. Mieyal, Strongsville, Ohio

[73] Assignee: Donn Incorporated, Westlake, Ohio

[21] Appl. No.: 973,852

[22] Filed: Dec. 28, 1978

[51] Int. Cl.[3] ..... E04B 5/52

[52] U.S. Cl. ..... 52/573; 52/669; 52/726; 52/DIG. 5

[58] Field of Search ..... 52/DIG. 5, 232, 726, 52/484, 762, 28, 588, 542, 523, 669, 664, 221, 145; 403/363

[56] References Cited

U.S. PATENT DOCUMENTS 380,109 3/1888 Harry ..... 52/542

3,284,977 11/1966 Lickliter ..... 52/DIG. 5

3,645,051 2/1972 Kolesar ..... 52/484

*Primary Examiner*—John E. Murtagh

*Attorney, Agent, or Firm*—Pearne, Gordon, Sessions, McCoy & Granger

[57] ABSTRACT

A channel structure for assembly into a suspended ceiling or the like and which is arranged to maintain the structural integrity of the ceiling during exposure to the heat of a fire. The channel structure includes an end splice arrangement having elements which develop a telescoping relationship between joined channels and thereby avoid buckling during thermally induced axial expansion of the channels.

5 Claims, 9 Drawing Figures

FIRE RATED CEILING

BACKGROUND OF THE INVENTION

The invention relates to an assembly system for facing, constructing or otherwise establishing walls, ceilings and like static structures. The invention is particularly suited for construction of suspended ceilings.

PRIOR ART

Parallel arrays of linear channels for suspended ceilings are disclosed, for example, in U.S. Pat. Nos. 3,295,284 to Tschiesche; 3,645,051 to Kolesar; and 3,678,641 to Englund. As shown in these patents, channels are typically suspended on carrier members or stringers extending crosswise to the longitudinal direction of the channels. In such prior systems, it is a common practice to join the ends of individual channels with an internal splice member, formed separately from the channel, and arranged to bridge between such ends when they are abutted. A problem encountered with such systems in the prior art is that the channels are susceptible to buckling when subjected to abnormally high temperature conditions. This buckling results when the ends of a channel are constrained against axial displacement under thermal expansion which may be induced, for example, by the heat of a fire. Buckling of the channels may result in their separation from the supporting carriers and consequent inpairment of the structural integrity of the system.

Heat induced failure of other types of suspended ceilings has been recognized. Many approaches have been proposed for avoiding buckling failure of the supporting grid members of tile type suspended ceiling constructions. U.S. Pat. 3,284,977 to Lickliter et al, for instance, shows examples of T-form grid elements which accommodate thermal expansion at their ends.

SUMMARY OF THE INVENTION

The present invention provides a channel arrangement for assembly of walls, ceilings and like static structures which is capable of accommodating the degree of thermal expansion which may be developed as a result of a fire while avoiding any tendency to buckle and thereby lose its structural integrity. In accordance with the invention, channels are provided with means for assuring that axial expansion of end joined channels is taken up by telescopic action between mating channel ends. While allowing relatively free axial expansion of individual channels, the disclosed elements are arranged to maintain positive lateral control between mating channel ends.

In the disclosed embodiment, one end of a channel, for convenience referred to hereafter as the "tail end," has integrally formed thereon a tongue of a size reduced to closely fit into the opposite or head end of a mating channel. The tongue is arranged to fit substantially completely into the adjacent channel to provide the aesthetically pleasing appearance of a butt joint when viewed at the front of the assembly. The elimination of separate splice elements avoids the possiblity of improper or faulty assembly at the point of manufacture and/or at the point of installation. The disclosed tongue, in effect, provides a concealed lap joint in which, in those instances where the channel elements are installed with any axial clearance, such clearance is practically imperceptible. This result is achieved because the tongue is conveniently and advantageously finished with the same texture and color and the main channel body and any exposed part of the tongue are visually difficult to distinguish from the main faces of the channels. The tail end of a channel, in addition to the aforementioned tongue, is also provided with local relief zones for reception therein of re-entrant or inturned parts of the mating channel head end. Such relief areas are effective to maintain positive lateral control between the mating ends by preventing the re-entrant parts of the mating channel head end from exhibiting any tendency to slide or snap off the mating channel tail end onto which it telescopes.

DESCRIPTION OF THE PREFERRED EMBODIMENT

Figures 1, 1A, 2:
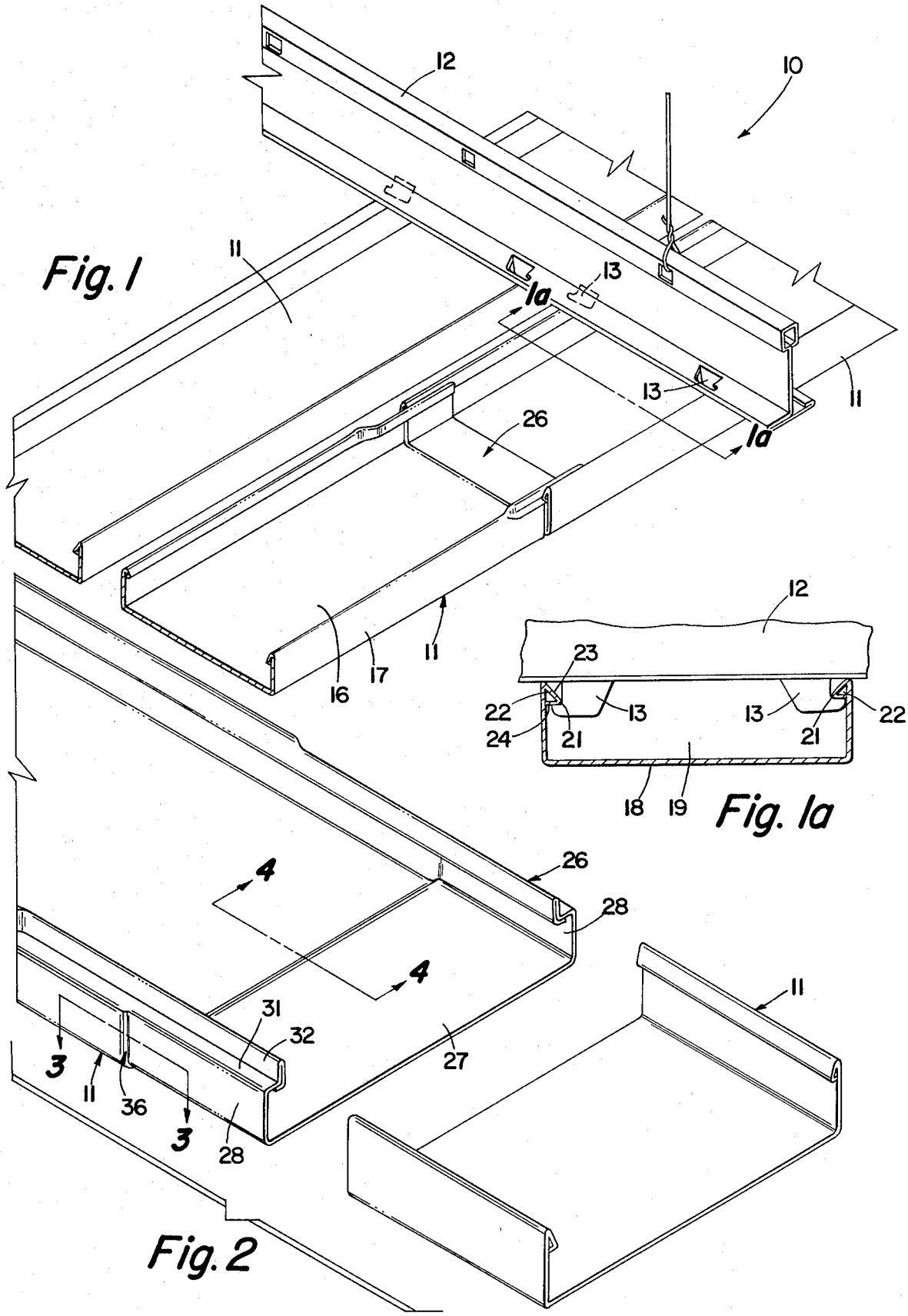
FIG. 1 is a perspective view of a static structure assembled from a plurality of channels constructed in accordance with the invention.
FIG. 1*a* is a cross sectional view taken across a plane transverse to the longitudinal direction of a chananel.
FIG. 2 is a perspective view of head and tail end portions of a pair of channels prior to coupling engagement therebetween.

Referring now to the drawings, there is shown a structure 10 in the form of a suspended ceiling comprising a plurality of elongated channels 11 supported on carrier or stringer members 12 spaced along the length of the channels and arranged crosswise thereto. The carriers 12, in turn, are suspended by wires or other conventional means from an overhead structure such as the main frame of a building. The channels 11 are joined to the carriers 12 by snapping the channels onto depending tabs 13 formed on the underside of the carriers in a generally conventional manner. Channels 11 are arranged side by side, usually with a constant spacing, to make up one dimension of a ceiling area and are arranged end to end to make up channel runs corresponding to the other dimensions of the area.

Each channel 11 is preferably substantially identical to the others, except of course, those which are modified at the site of installation to fit within the particular confines determined for the ceiling 10. As is apparent from the figures, each channel 11 is an elongated, longitudinally straight member having a generally U-shaped cross section. The channels 11 are ideally fabricated from sheet materials, such as aluminum or steel sheet stock of any common architectural finish, and are preferably rolled into their final cross sectional configuration from strips of such sheet stock. The material selected for their manufacture should have sufficient resilience to allow a channel 11 to be snapped onto the carrier tabs 13 with enough springback of the material to prevent unwanted loosenness or separation between the channels and carrier tabs. The geometry of the illustrated channels is not critical and various changes in the depth, width or length of the channels, for instance, may be routinely made as desired.

A major portion of the length of the channel 11 has a constant cross section. In the illustrated case, the channel or pan 11 comprises a web 16 and a pair of flanges 17. A surface 18 of the web 16 is considered to be the front face of the channel 11 and is that surface which would be most visible to an observer within a room associated with the ceiling 10. The flanges 17 are integral with the longitudinal edges of the web 16 and extend rearwardly at right angles to the web, which in the illustrated example, but not necessarily, is planar. The flanges 17 cooperate with the web 16 to form a channel cavity 19 into which the depending carrier tabs 13 extend. The flanges 17 are re-entrant or inturned so that they mutually define between opposite points 21 an imaginary plane parallel to the web 16. At these points 21 spacing between the flanges 17 is less than that between other areas of the flanges between such imaginary plane and the web 16. The re-entrant or inturned geometry conforms to the geometry of the depending carrier tabs 13 so that once such tabs snap into the zone between the imaginary plane and the web 16, the channel is adequately retained on the carrier tabs.

The disclosed channel 11 is characterized by the flanges 17 having their principal portions generally planar and at right angles to the web 16. The free longitudinal edges of the flanges 17 are rolled or inturned to form longitudinal hollow lips 22 of triangular cross section, which serve to stiffen their respective flanges. Inward corners of the triangular lips 22 form the aformentioned re-entrant points 21. Skewed, somewhat rearwardly facing surfaces 23 of the lips 22 are in planes forming acute angles with their respective main flange bodies and are adapted to cam their respective flanges 17 laterally outwardly when cooperating with the carrier tabs 13 to facilitate installation thereon. Inturned surfaces 24 of the lips 22 are in planes generally at right angles with respect to the flanges 17 so that when they are snapped onto the carrier tabs 13, forces tending to spread the flanges are generally not developed by these surfaces and the panels are not readily dislodged from the carrier tabs by accidental blows or other extraneous forces.

At a tail end of the channel 11 there is formed a tongue 26 for end splicing, and thereby aligning, the channel 11 to the head end of another channel. The tongue 26 is integerally formed on the channel 11 by swaging or a like process wherein material of the channel is displaced to reduce the effective width and depth of the channel stock. The tongue 26, accordingly, is provided with a web 27 having a width dimensioned to provide a slip fit with a nominal inside dimension between the main flanges 17 of a mating channel as measured at the point where the main flanges join the main web 16 of such mating channel. Flanges 28 of the tongue 26, it will be understood, are similarly spaced and configured to fit within the main flanges 17 of the mating channel. The longitudinal free ends of the tongue flanges 28 are severely distorted from their original configuration. This distortion includes collapsing of the hollow lip area, formation of an inturned step 31 generally parallel to the tongue web 27 and an offset flange portion 32 generally parallel to the associated tongue flange portion 28.

Figure 7:
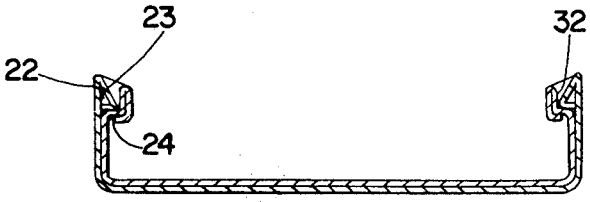
FIG. 7 is a cross sectional view, taken along the line 7—7 indicated in FIG. 5, of the mating channel ends in their normal coupled condition.

As shown in FIG. 7, the depth of the tongue flanges 28 (i.e. the dimension which these flanges extend away from the tongue web 27) is limited to less than the spacing between the flange lip surface 24 and the main web 16 so that no major interference exists between these areas when the tongue is disposed within the head end of a mating channel. Similarly, the tongue flange offsets 32 are spaced inwardly a sufficient distance from the planes of the tongue flanges 28 to avoid interference with the extreme re-entrant points 21 of the flange lip 22.

Figure 3:
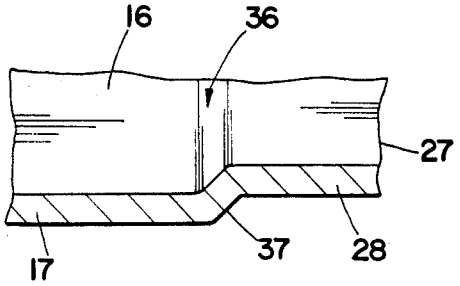
FIG. 3 is a fragmentary cross sectional view, taken along the lines indicated in FIG. 2, of a side wall or flange of the channel tail end portion.
Figure 4:
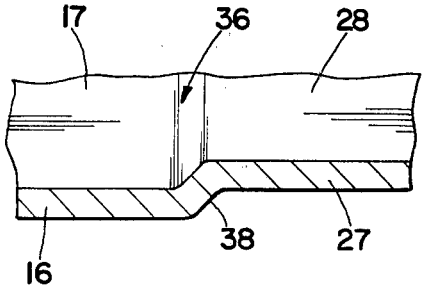
FIG. 4 is a fragmentary cross sectional view taken along the lines indicated in FIG. 2 of a web of the channel tail end portion.

Intermediate the integral tongue or splice 26 there is formed a cross sectional transition zone 36. The transition area or zone 36 is generally aligned with an imaginary plane transverse to the longitudinal axis of the channel 11. As indicated in FIGS. 3 and 4, external surface areas 37 and 38 forming the transitions associated with the flanges 17,37 and web 16,38, respectively, are substantially completely oblique to an imaginary plane perpendicular to the longitudinal axis of the channel. Inspection of the FIGS. reveals that the main flanges 17 are distorted axially inwardly of the transition zone 36 to provide a corresponding axially inward extension of the inturned step 31 and offset flange portion 32 to a point generally designated 39. This distortion forms a relief area for possible reception of areas of the lips 22 of the mating channel head end, as discussed below.

Figure 5:
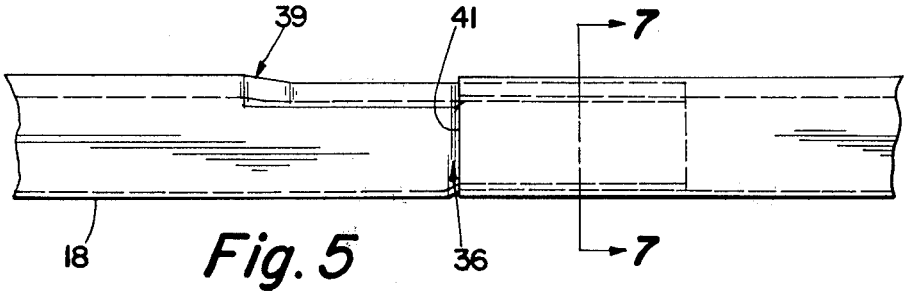
FIG. 5 is a fragmentary side elevational view of the channel head and tail portions of FIG. 3 in a normal coupled condition.

As may be comprehended from the previous discussion, to develop an end splice between channels 11, the tongue 26 at the tail end of one channel is inserted into the head end of an adjacent channel. This is accomplished by either relative axial motion between the main channels or by spreading and snapping the main flanges 17 at the head end of a channel over the tongue of the other channel in a manner similar to snapping such flanges over the carrier tabs 13. This installation splice is completed when a moderate axial compressive force is applied between the channels and the edge, designated 41 (FIG. 5), of the channel head end engages portions of the cross sectional transition zone surfaces 37, 38. The result is that from a normal viewing position, an observer will perceive what looks likes a simple butt joint between the edge 41 of one channel and the cross sectional transition zone surfaces 37, 38 of the other channel. Any separation of this edge 41 from the transition area surfaces 37, 38 will be practically unnoticeable, since the tongue 26 is ordinarily finished with the same color and texture as that applied to the main portions of the channel 11 and to discriminate between the tongue and front face 18 of the web 16 takes relatively close inspection.

Figure 6:
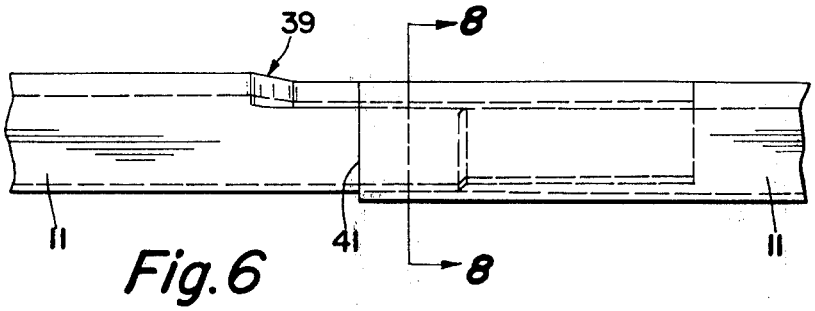
FIG. 6 is a fragmentary side elevational view, similar to FIG. 5, but with the channel head and tail portions in abnormal telescoping relation resulting from excessive axial compressive forces between these channels.
Figure 8:
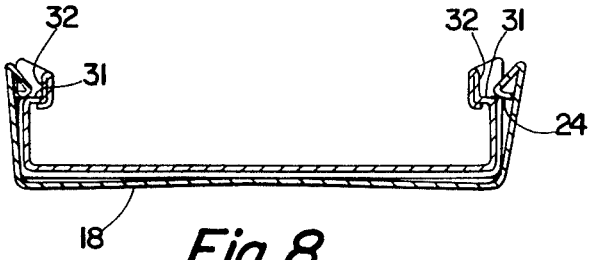
FIG. 8 is a cross sectional view, taken on the line 8—8 indicated in FIG. 6, of the mating channel ends in the abnormal telescoped condition.

When an unusually high axial compressive force exists between spliced channels, such as that which might be produced upon thermal expansion induced by a fire, the edge 41 is cammed laterally outwardly both across the web 16 and flanges 17 by the cross section transition zone surfaces 37, 38 respectively. The head end of one channel thereby telescopes over the tail end of the mated channel. It will be seen from inspection of FIGS. 6 and 8 that the relief area formed above the inturned step surface 31 axially inwardly of the cross sectional transition zone 36 receives the hollow flange lips 22 of the head end of the mating channel. Stated in other words, the inturned lip surfaces 24 of the head end of the channel extend over the inturned step surfaces 31 of the tail end of the other channel in the abnormal telescoped position illustrated in FIGS. 6 and 8 to thereby assure that even in this abnormal condition, a positive degree of control is maintained between these channel ends. Relative lateral movement, i.e., movement in any direction in a plane perpendicular to the longitudinal axes of the channels at their mated ends, or any relative angular movement between the channels about their longitudinal axes, is prohibited by the maintained telescoping relationship of the various elements of the channels.

Although the preferred embodiment of this invention has been shown and described, it should be understood that various modifications and rearrangements of parts may be resorted to without departing from the scope of the invention as disclosed and claimed herein.

What is claimed is:

1. An elongated member for forming, with like members, the finish plane of a ceiling, wall, or other similar structure, said member being substantially straight in its longitudinal direction, said member having a generally U-shaped cross section, the U-shaped cross section being defined by a web and a pair of flanges adjacent opposite longitudinal edges of the web and extending with re-entrant portions generally at right angles of the web, tongue means at one end of said member for extending into and joining the adjacent end of a like mating member, said tongue means having means for aligning the end of its associated channel member with the adjacent end of the like mating member in a manner such that the webs of said channel and like mating members are coplanar, said aligning means being capable of aligning said member ends by restricting lateral movement therebetween in directions in a plane perpendicular to the longitudinal axis of said members, and angular movement about an axis parallel to the longitudinal axis of said members, and abutment means for determining a normal end-to-end relationship between said members, said abutment means and aligning means being constructed and arranged to cooperate to normally maintain the webs of said channel and like mating members coplanar and to produce the appearance of a butt joint between the ends of their webs and portions of the ends of their flanges, said abutment means including cam means for automatically allowing the web and flanges of the adjacent end of the like mating member to telescope with the web and flanges of said one end when an abnormal axial force is developed in said like mating member against said member, said member having on said flanges adjacent said one end and axially inward of said abutment means relief areas, said relief areas being arranged to receive re-entrant portions of flanges of said like mating member when the like mating member telescopes on said member to thereby reduce any tendency of said member to disengage upon telescoping action.

2. An elongated channel member for forming, with like members, the finish plane of a ceiling, wall, or similar structure, said channel member being formed of sheet-like resilient material and being substantially straight along its longitudinal direction, said channel member having a generally U-shaped cross section defined by a web and a pair of flanges adjacent and integral with opposite longitudinal edges of the web, each of said flanges extending rearwardly at an angle from the web and forming the re-entrant sides of a channel cavity wherein the minimum side-to-side dimension between said flanges occurs at an imaginary plane spaced rearwardly of said web, said flanges being adapted to snap over a carrier body having elements suitably configured to expand said flanges and snap into said channel at a point between said imaginary plane and said web to thereby mount said channel member to said carrier, tongue means at one end of said channel member for extending into and joining the adjacent end of a like mating member, said tongue means having means for aligning the end of the channel member with the adjacent end of the like mating member in a manner such that the webs of said channel and like mating members are coplanar, said aligning means being capable of aligning said member ends by restricting lateral movement therebetween in directions in a plane perpendicular to a logitudinal axis of said channel member, and angular movement about an axis parallel to the longitudinal axis of said channel member, and abutment means for determining a nominal end-to-end relationship between said members, said aligning and abutment means being constructed and arranged to cooperate to normally maintain the webs of said channel and like mating members coplanar and to produce the appearance of a butt joint between the ends of their webs and portions of the end of their flanges, said abutment means including cam means for causing the adjacent end of the like member to telescope over said one end when an abnormal axial force is developed in said like member against said channel member, said cam means being constructed and arranged to cause the web of the adjacent end to slide over a forward face of the web of said channel member and cause the flanges of the adjacent end to spread away from one another over the respective flanges of the channel member, said channel member having on its respective flanges adjacent said one end and axially inward of said abutment means relief areas, said relief areas being arranged to receive re-entrant portions of flanges of said like mating member when the like mating member telescopes on said channel member to thereby reduce any tendency of said members to disengage upon telescoping action.

3. A channel member as set forth in claim 2, wherein said tongue means including said aligning means in integrally formed with said channel member, whereby the channel member and the like member are joined at their respective ends solely by themselves and are free of separate joint forming parts, the joint formed by said members being substantially a lap joint whereby the end edges of said members each overlie the other member such that the possibility of mutual abutment of said end faces and the consequent risk of buckling action are precluded.

4. A channel member as set forth in claim 3, wherein said tongue is U-shaped in structure and has dimensions sized to readily fit within corresponding dimensions in said like mating member.

5. In a ceiling structure, the combination comprising a plurality of spaced parallel carriers suspended overhead from a building framework, a plurality of elongated channels supported by and beneath the carriers, said channels being like one another and being arranged crosswise to said carriers parallel to one another in a planar array, individual ones of said channels being connected in head-to-tail fashion to make up channel runs of desired length, each of said channels being formed of sheetlike material and having a generally U-shaped nominal configuration defined by a web and opposed re-entrant flanges along a main portion of its length, a tail end of said channel having an integral tongue portion dimensioned to telescope within the U-shaped nominal configuration of another channel member at its head end, said channel members having a cross section transition portion intermediate said main portion and said tongue portion, said transition portion being aligned with a plane transverse to the longitudinal axis of said channel, said transition portion being formed by surfaces adjacent said web and said flanges which are substantially entirely at an acute angle with respect to the longitudinal axis of the channel, said acutely oriented surfaces of said transition portion being adapted to cam the head end of an adjacent channel into telescoping telation with said channel axially inward of said tongue upon application of excessive comressive end forces on said channels, said telescoping being accomplished by said acutely inclined transition portion surfaces through displacement of the web of the adjacent channel in a forward direction and camming the flanges of the adjacent channel laterally outwardly in directions opposite one another, said channel having on its respective flanges adjacent said tail end and axially inward of said transition portion relief areas, said relief areas being arranged to receive re-entrant portions of flanges of the head end of the adjacent channel when the adjacent channel telescopes on said channel member to thereby reduce any tendency of said channels to disengage upon telescoping action.

* * * * *